US006305192B1

(12) United States Patent
Indiveri et al.

(10) Patent No.: US 6,305,192 B1
(45) Date of Patent: Oct. 23, 2001

(54) APPARATUS FOR INCREASING PIERCING SAFETY

(75) Inventors: Peter A. Indiveri, River Vale; Marc J. Bernhardt, Upper Saddle River, both of NJ (US)

(73) Assignee: Inverness Corporation, Fairlawn, NJ (US)

( * ) Notice: Subject to any disclaimer, the term of this patent is extended or adjusted under 35 U.S.C. 154(b) by 0 days.

(21) Appl. No.: 09/659,656

(22) Filed: Sep. 11, 2000

(51) Int. Cl.[7] ..... A44C 7/00
(52) U.S. Cl. ..... 63/12; 63/29.1
(58) Field of Search ..... 63/1.11, 1.16, 63/12, 13, 14.1, 14.9, 29.1, 29.2, 40

(56) References Cited

U.S. PATENT DOCUMENTS

| | | | |
|---|---|---|---|
| Re. 35,511 | | 5/1997 | Nakamura . |
| 466,287 | * | 12/1891 | Berlepsch ..... 63/29.1 |
| 758,848 | | 5/1904 | Pejchar . |
| 2,601,424 | | 6/1952 | Baker . |
| 2,752,764 | | 7/1956 | Lederer . |
| 3,418,826 | | 12/1968 | Wieshuber . |
| 3,504,507 | | 4/1970 | Ferro . |
| 3,509,734 | | 5/1970 | Lederer . |
| 3,890,800 | | 6/1975 | Montague . |
| 3,997,686 | | 12/1976 | McClure . |
| 4,030,507 | | 6/1977 | Mann . |
| 4,059,971 | | 11/1977 | Shoji . |
| 4,186,567 | | 2/1980 | Monden et al. . |

(List continued on next page.)

FOREIGN PATENT DOCUMENTS

| | | |
|---|---|---|
| 656059 | 1/1963 | (CA) . |
| 736482 | 9/1955 | (GB) . |
| 54-114378 | 9/1979 | (JP) . |

*Primary Examiner*—B. Dayoan
*Assistant Examiner*—Andrea Chop
(74) *Attorney, Agent, or Firm*—Fish & Neave; Robert W. Morris; Joel Weiss

(57) ABSTRACT

Systems, methods and apparatus for increasing piercing safety are provided. An ear piercing system that includes a piercing post having a magnet and an alignment target, and ornamental earring elements that may also include a magnet (of opposing polarity) and alignment target. The natural attraction of the magnets (or ferromagnetic material), in conjunction with the alignment targets, permits individuals to easily remove and replace ornamental earring elements without risk of inadvertent or intentional premature removal of the piercing post subsequent to ear piercing procedures.

35 Claims, 4 Drawing Sheets

U.S. PATENT DOCUMENTS

| | | | | |
|---|---|---|---|---|
| 4,195,492 | | 4/1980 | Johnson . | |
| 4,682,477 | | 7/1987 | Vaillancourt . | |
| 4,781,036 | | 11/1988 | Erickson . | |
| 4,783,974 | | 11/1988 | Hernandez . | |
| 4,899,556 | * | 2/1990 | Ford | 63/14.1 |
| 4,912,944 | | 4/1990 | Crosley et al. . | |
| 4,982,581 | | 1/1991 | Furuyama . | |
| 4,996,851 | * | 3/1991 | Schinzinger et al. | 63/26 |
| 5,004,470 | | 4/1991 | Mann . | |
| 5,004,471 | | 4/1991 | Mann . | |
| 5,007,918 | | 4/1991 | Mann . | |
| 5,034,979 | | 7/1991 | Erickson . | |
| 5,036,681 | | 8/1991 | Schaerer . | |
| 5,048,310 | * | 9/1991 | Riley | 63/13 |
| 5,076,072 | * | 12/1991 | Payne | 63/12 |
| 5,097,682 | | 3/1992 | Nakamura . | |
| 5,099,659 | | 3/1992 | Carranza et al. . | |
| 5,144,952 | | 9/1992 | Frachet et al. . | |
| 5,154,068 | | 10/1992 | DiDomenico . | |
| 5,165,257 | | 11/1992 | Corenblith . | |
| 5,195,336 | | 3/1993 | Mershon . | |
| 5,203,183 | | 4/1993 | Salerno . | |
| 5,353,608 | | 10/1994 | Berkowitz . | |
| 5,355,698 | | 10/1994 | Edmark . | |
| 5,367,891 | | 11/1994 | Furuyama . | |
| 5,375,433 | | 12/1994 | Skalet . | |
| 5,411,516 | | 5/1995 | Thomas . | |
| 5,465,593 | | 11/1995 | Takasu . | |
| 5,466,431 | | 11/1995 | Dorfman et al. . | |
| 5,526,551 | | 6/1996 | Herman . | |
| 5,542,157 | | 8/1996 | Herman . | |
| 5,632,163 | | 5/1997 | Inoue . | |
| 5,765,751 | | 6/1998 | Joshi . | |
| 5,797,281 | | 8/1998 | Fox . | |
| 5,873,265 | | 2/1999 | Simonneti . | |
| 5,921,110 | | 7/1999 | Middendorff et al. . | |
| 5,974,634 | | 11/1999 | Eisenpresser . | |

* cited by examiner

APPARATUS FOR INCREASING PIERCING SAFETY

BACKGROUND OF THE INVENTION

The present invention relates to systems, methods and apparatus for piercing. More particularly, the present invention relates to providing increased incentive to people who have recently had their ears, or other body parts, pierced to follow the prescribed healing regimen before removing the post from their ear. The principles of the present invention may also be applied to ongoing preventative health maintenance of pierced ears.

While pierced earrings are the most popular version of earring available, they do require that a hole be made in the ear (e.g., the earlobe, ear cartilage). It is well known that the recommended follow-up procedure for new piercings is to keep the inserted post in the ear for a prescribed healing regimen that, typically, exceeds one month, and may be as long as three months. Moreover, the follow-up procedure also typically calls for at least a daily rotation of the post so that the healed portion of the ear does not adhere to the post. The equipment used to pierce ears, such as that described in Mann U.S. Pat. No. 4,030,507, entitled "Sterile Earlobe-piercing Assembly", often utilizes a decorative part of the new earring that is commonly a small, simple, ball-shaped ornament.

One of the reasons individuals get their ears pierced, however, is a desire to use many highly decorative, different-sized earrings, which frequently results in people prematurely removing the "starter" earring that was inserted as part of the piercing process. For example, health problems such as infections may result in the premature use of non-sterile earrings that may be made from, for example, lesser quality metals that may have a more severe effect on the healing portion of the ear than would be experienced by a long time pierced earring user (typical "first-time" earrings are often made of relatively pure, high quality materials such as gold). This, unfortunately, can lead to infection and discomfort which, if not addressed in a timely manner, may result both in health problems for the individual, and the loss of a pierced earring customer for the jewelry industry.

Similar problems also may occur with individuals who do not wear their pierced earrings on a regular basis. Under these circumstances, the pierced hole may begin to close, or it may become easily infected from the infrequent insertion of earring posts into the pierced hole.

Other individuals have attempted to resolve these problems. For example, Ferro U.S. Pat. No. 3,504,507 describes methods of varying an ornamental element of an earring. Ferro describes an earring post having a mechanical means at one end for attaching and detaching ornamental elements. Ferro, however, requires that the post have, at the non-ornamental end, a disc which acts as the earring backing. Thus, the post itself is inserted into the ear after the ear has been pierced. Moreover, Ferro utilizes an interlocking mechanism for attaching and detaching the ornamental element, which may result in the post being inadvertently removed from the pierced hole while changing the ornamental element. Even if the post is not removed, the manipulation required to attach and detach the ornamental element can cause inadvertent bleeding and tearing of the tender, newly pierced, delicate tissue.

Hernandez U.S. Pat. No. 4,783,974 describes re-attachable break-a-way ornaments and necklaces. These devices include a post having one end that passes through the pierced hole and is attached to a conventional backing behind the earlobe. The other end includes a male connector or iron core that may be removably attached to a necklace or other ornamental element. Hernandez is not a piercing earring. Moreover, Hernandez, like Ferro, utilizes a post that is inserted into the pierced hole subsequent to the piercing procedure. This may result in discomfort, pain or even infection occurring in the newly pierced ear. Moreover, Hernandez's mechanical interlock also may result in inadvertently withdrawing the post from the ear during ornamental changes, or even long after the healing process is complete.

Erickson U.S. Pat. No. 4,781,036 also describes a pierced-ear earring with changeable decorative earring elements. Erickson, like Ferro, describes a mechanical interlock for attaching the ornamental element to the post. Moreover, Erickson requires that the attachment mechanism be screwed on and unscrewed from both ends of the post, which may result in the post being inadvertently withdrawn from the pierced hole during ornamental element changes.

Thomas U.S. Pat. No. 5,411,516 describes an ear piercing device and method that "allow[s] conventional earring posts to be interchangeably inserted into and withdrawn from the pierced ear throughout the healing process" (see Abstract). Thomas, unlike Ferro and Hernandez, utilizes a post that remains in the pierced hole during the healing process. That post, however, is a hollow tube having a substantially larger diameter than conventional piercing posts. The hollow tube presents two potential problems. First, the larger tube creates a larger diameter wound than would otherwise be necessary. This may result in a larger than desired hole in the ear. Seccond, unless the tube sticks sufficiently far enough out of the pierced cavity, the user will be unable to perform the daily rotation required during the healing process. Once the tube is in place, a rubber plug is inserted into an even larger cavity that is positioned on the ear lobe over the pierced hole. The conventional post is then inserted into the rubber plug, which retains the conventional post via friction. This method, however, also may be prone to inadvertent removal of the hollow post if too much force is applied during withdrawal, and may cause tearing of the delicate tissue during the healing process. Further, the presence of bodily fluids and antiseptic solutions may reduce the frictional grasp of the rubber plug, causing additional problems.

For at least the above reasons, it is an object of the present invention to provide ear piercing methods and apparatus that enable a user to easily change ornamental earring elements during the healing period after ear piercing has occurred.

It is also an object of the present invention to provide ear piercing methods and apparatus that utilize a post for piercing that remains secured within the pierced hole during the healing period.

It is a still further object of the present invention to provide ear piercing methods and apparatus that permit a user to easily remove and replace ornamental earring elements with a minimum of force so that the earring post remains within the pierced hole.

It is an additional object of the present invention to allow a user to wear a wide variety of larger, more delicate, non-metallic, or asymmetrical decorations during the healing regimen.

SUMMARY OF THE INVENTION

The above and other objects of the present invention are accomplished by the systems, methods and apparatus described herein in which a piercing post includes a magnet and an alignment target, and the ornamental earring includes a ferromagnetic material that is attracted to the piercing post magnet. In some embodiments of the present invention, the ornamental earring is provided with an opposite polarity magnet that further aides the mating process. The systems include a plunger device that retains the piercing post of the present invention and a fastener back. Piercing is preferably performed by a trained individual who cleans the portion of the body to be pierced and depresses a plunger after aligning the piercing device with the desired location. The piercing post is inserted through the body part (such as the ear) and the fastener back is automatically engaged so that the post is held in place in the pierced hole. Persons skilled in the art will appreciate that the present invention is particularly described with respect to ear piercing for convenience, and that the principles of present invention apply equally to any body piercing.

Once the piercing procedure is complete, the individual may then place a selected ornamental element in general alignment with the alignment target at the protruding end of the piercing post. The natural attraction of the two magnets, in combination with the alignment targets, provides almost automatic alignment of the ornamental element on the post. When a different ornamental element is desired, the user may simply take off the current element and replace it with a different one. The use of the two magnets and alignment targets reduces the difficulty for removal of the ornamental elements in comparison to known systems and methods. For example, a user of the present invention may simply apply a slight pressure to one side of the ornamental element to dislodge it. The ornamental element, however, is protected from inadvertent removal because the earlobe provides a natural, even backing.

The use of the present invention provides numerous health benefits to the user. The user can easily change the size and/or style of the ornamental element throughout the prescribed healing regimen without being tempted to prematurely remove the piercing post from the pierced location. For example, conventional piercing systems are often limited to a simple gold ball or similar ornament. The present invention enables a user to wear other styles of earrings during the healing process, such as dangling earrings, that would otherwise not be possible without the premature removal of the piercing post. Moreover, the alignment targets provide an easily manipulated surface for the user to perform the prescribed rotation of the piercing post during the healing regimen. These advantages are obtained through the use of a conventional sized piercing post that prevents the user from having to have an oversize piercing hole made.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE DRAWINGS

The systems, methods and apparatus of the present invention provide individuals with the ability to easily and safely replace ornamental earring elements without having to prematurely remove the piercing post used in the initial piercing and healing of the ear or other body part.

Figure 1:
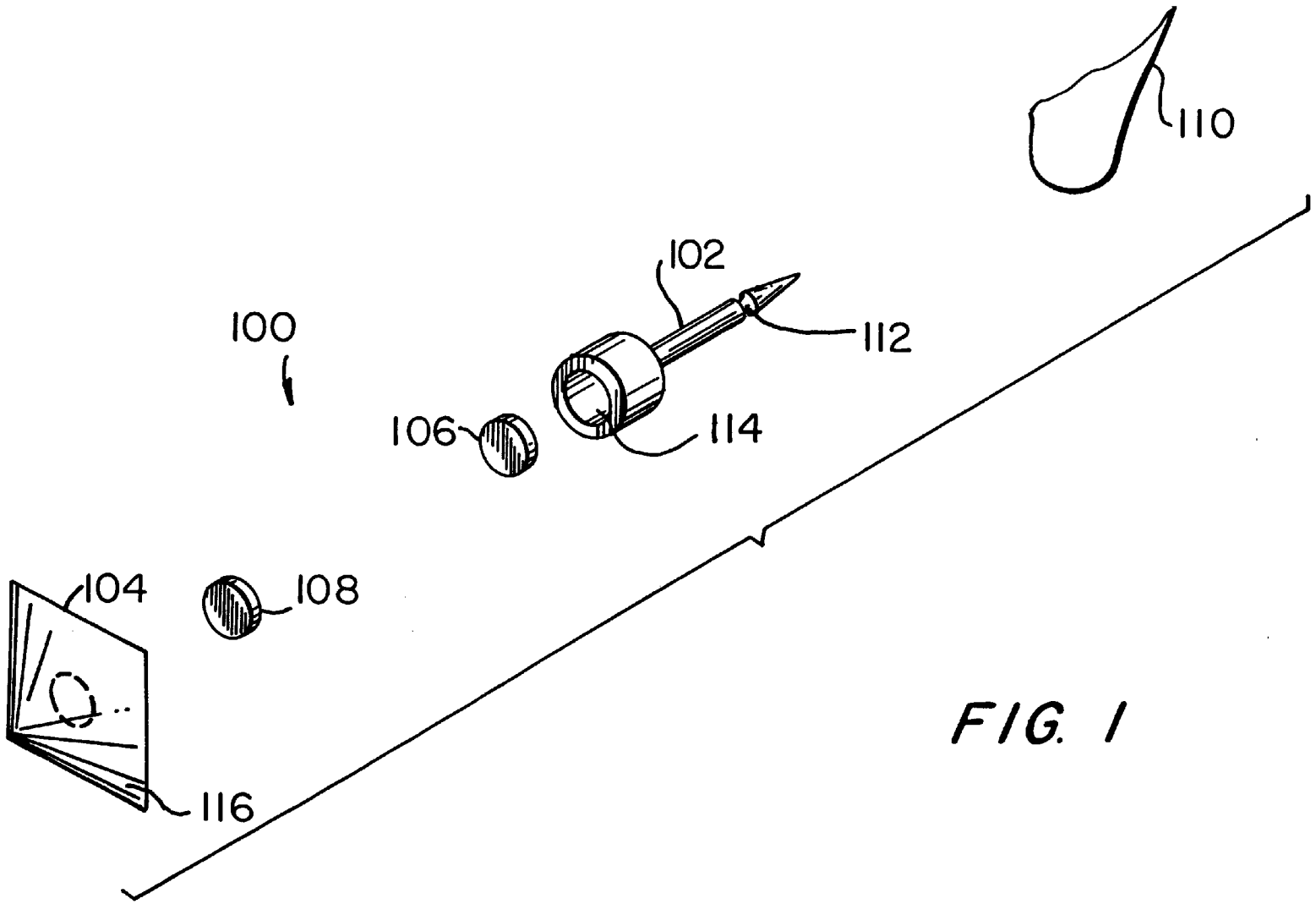
FIG. 1 is an exploded perspective illustration of a piercing earring device in accordance with the principles of the present invention.

FIG. 1 shows an illustrative exploded view of a disassembled version of a pierced earring 100 constructed in accordance with the principles of the present invention. Pierced earring 100 includes a piercing post 102, an ornamental element 104, first magnet 106, and second magnet 108. While second magnet 108 is shown in FIG. 1, persons skilled in the art will appreciate that ornamental element 104 may include a target made of a ferromagnetic material, such as steel, that can be adhered to the element instead of a second magnet. This embodiment, however, may not provide as good magnetic coupling as two magnets. A backing (not shown in FIG. 1) may also be included in pierced earring 100 to hold the earring in place after insertion through body part 110. For purposes of illustration, body part 110 is shown to be an earlobe, but persons skilled in the art will appreciate that body part 110 could in fact be any body part that may be pierced. This includes for example, without any limitation, the upper cartilage portion of an ear, the navel area (where jewelry is often worn), and the eyebrow area. It may be preferable to utilize magnets formed from rare earth materials, which provide additional benefits, such as being light weight in comparison to the force of their magnetic attraction.

Piercing post 102 may include one or more indentations 112 that may be used to facilitate keeping the piercing post in place after it has been inserted into the appropriate body part. When such an indentation is used, a backing is used that engages the indentation 112 to further reduce the chance that the piercing post becomes inadvertently removed from the ear prior to the termination of the healing period. Persons skilled in the art will understand that a backing may be used regardless of whether or not an indentation 112 is present. Moreover, the backing may be a device that engages indentation 112, or it may be any other device that acts to prevent premature removal of the piercing post, such as a small block of rubber that may be held in place by friction, or a more complicated clasp system that requires some form of mechanical action for its removal (the complicated clasp system is not a preferred backing for use during the healing process because it may cause bleeding and/or tearing of the tender tissue).

Piercing post 102 includes a cavity 114 that acts as a post alignment target for ornamental element 104, which itself may act as a mating alignment target. One advantage of cavity 114 is that, being formed as a receptacle having one or more side walls, it provides the user with a surface for performing the required rotation of piercing post 102 during the heating period. First magnet 106 is permanently mounted within cavity 114 such that its width does not fill cavity 114. The remaining space in cavity 114 will be filled by second magnet 108, which is permanently mounted to ornamental element 104, when ornamental element 104 is mounted to piercing post 102. First and second magnets 106 and 108 are aligned with respect to each other such that their polarity causes them to be magnetically attracted to each other. Alternatively, second magnet 108 may be considered the mating alignment target.

In either instance, the natural attraction of the magnets enables a user to easily change the ornamental element of a newly pierced earring prior to, as well as after, the expiration of the healing period. Removal of ornamental element 104, for example, may be performed by applying gentle pressure on surface 116 of element 104, such that the pressure overcomes the natural magnetic attraction between first and second magnets 106 and 108. Ornamental element 104 is then easily removed by the user who may replace it with a different ornamental element, as the occasion suits.

Figure 2:
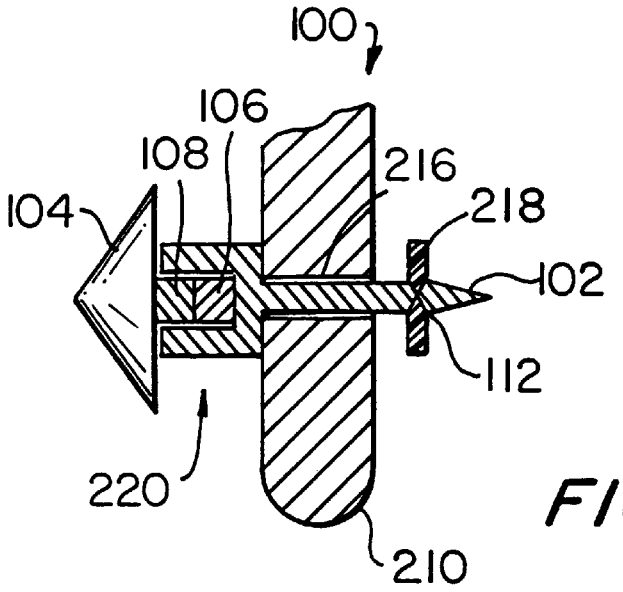
FIG. 2 is a longitudinal sectional view of an assembled version of the pierced earring of FIG. 1 after insertion through an ear.

FIG. 2 shows a longitudinal, sectional, illustration of a completely assembled version of pierced earring 100 of the present invention. In this case, piercing post 102 has been inserted through body part 210 such that a narrow cavity 216 is placed therein. One advantage of the present invention is that cavity 216 may be the same size as standard pierced earring posts. Also shown in FIG. 2, that was not shown in FIG. 1, is an illustration of backing 218. As previously described, backing 218 may be any form that aids in preventing premature removal of piercing post 102 from body part 210. In this instance, backing 218 takes the form of a plastic disc having a hole with a slightly smaller size than piercing post 102. The hole in backing 218 slides across the point of piercing post 102 until it engages indentation 112.

FIG. 2 also better illustrates how piercing post 102 includes a cup section 220 that acts as a post alignment target for ornamental element 104. First magnet 106 is within cup section 220 to magnetically engage second magnet 108 when an ornamental element is mounted to piercing post 102. Second magnet 108 is permanently mounted to ornamental element 104 such that it extends therefrom, which enables it to fit within the confines of cup section 220. The natural magnetic attraction between first and second magnets 106 and 108 keeps ornamental element 104 in place while it is worn. While first and second magnets are shown to be cylindrical or disc-shaped portions, persons skilled in the art will appreciate that they may instead be other shapes such as any multi-sided shape. For example, the magnets may be squares. Moreover, while it may be preferred to have both magnet be the same shape, rather than different shapes. For example, magnets 106 and 108 may be squares, hexagons, or any other shape. In addition, while it may be advantageous for magnets 106 and 108 to be of the same shape, persons skilled in the art will appreciate that the principles of the present invention may be practiced using different shaped magnets.

Figure 3:
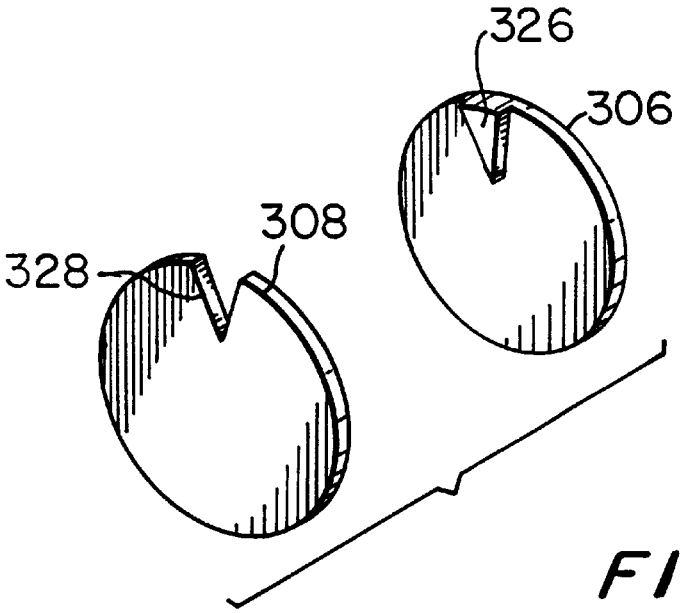
FIG. 3 is an illustration of an embodiment of the present invention in which he pierced earring of FIG. 1 includes keying.

FIG. 3 shows one example of an additional embodiment of the present invention in which keying is used. Keying may be particularly desirable because the keying will help retain the ornamental element in place while the wearer performs the daily regimen of rotating the newly pierced earring. Without keying, the ornamental element may slip or come off, thereby potentially discouraging the earring wearer from performing the prescribed rotation. In addition, the keying may also help align the mating targets and the ornamental element. It should be understood, however, that the use of keying should be implemented such that the ornamental element may still be easily removed. For example, in accordance with the present invention, the keying may be as simple as manufacturing a male keying in the shape of a triangle, and a female keyway having a similarly shaped triangle that is slightly larger in size. Thus, the mating of the keying in the keyway should add little or no additional force over the magnetic attraction force that causes the two components to come together (i.e., the two components should not be held in place by force such as, for example, friction, and instead are substantially held in place by magnetic force). Such an interlocking may result in discomfort or pain for the user, or even bleeding or tearing of the tender tissue during ornament replacement.

The keying feature of this embodiment of the present invention is shown with respect to first and second magnets 306 and 308, respectively. In this instance, first magnet 306 includes a male keying 326, and second magnet 308 includes a female keying (or keyway) 328. Persons skilled in the art will appreciate that the male and female keying may be switched between first and second magnets 306 and 308, such that first magnet 306 includes a female keying and second magnet 308 includes a male keying. The keyings themselves may be any shapes, like the magnets themselves, which also may be of any shape.

Figure 4:
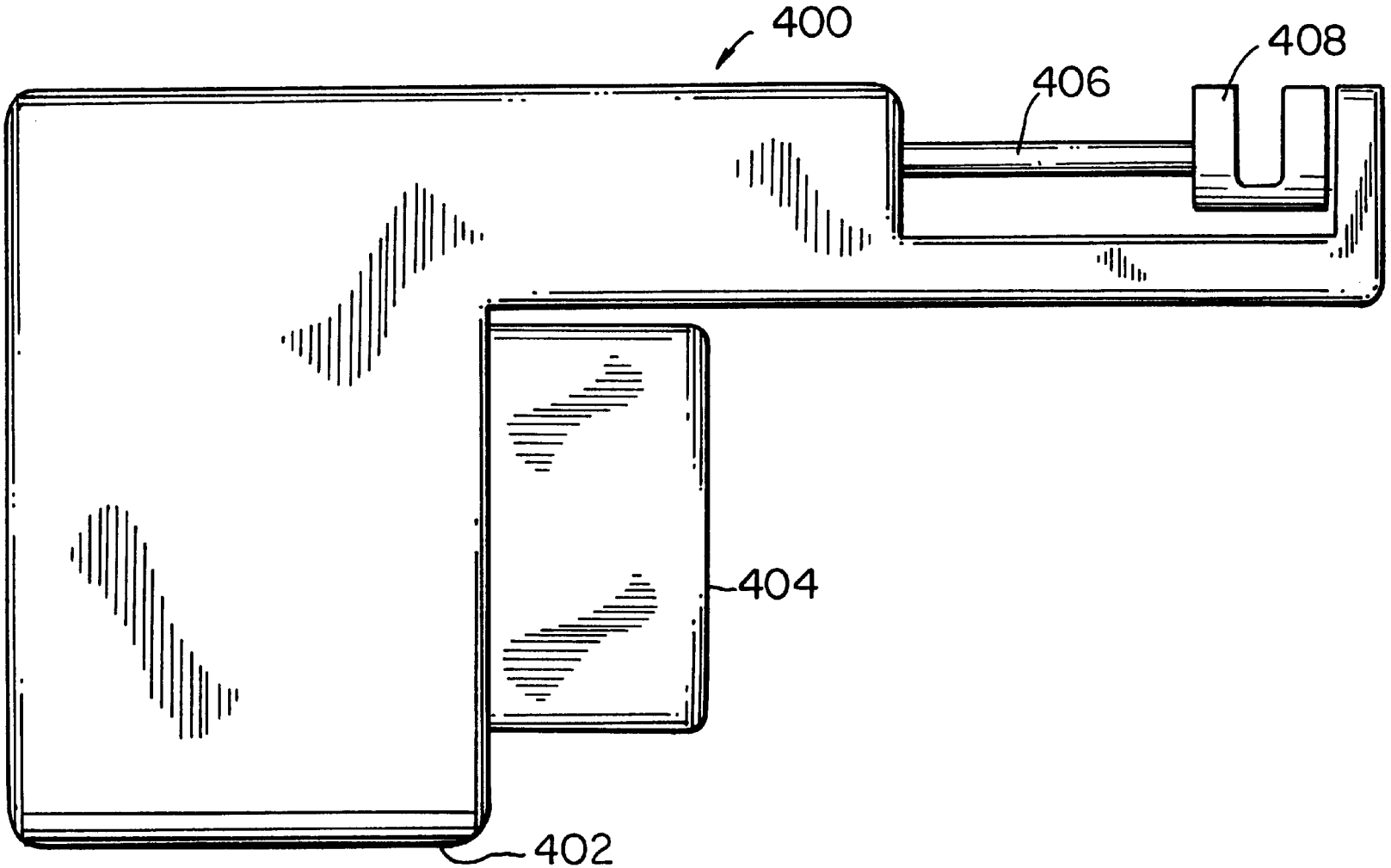
FIG. 4 is an illustration of a system for performing piercing in accordance with the principles or the present invention.

FIG. 4 is an illustration of a piercing system 400 constructed in accordance with the principles of the present invention. Piercing system 400 may include a conventional piercing instrument 402, such as those described in U.S. Pat. Nos. 4,030,507, 5,004,470, 5,004,471, and 5,007,918, all of which are assigned to Inverness Corporation, and all of which are incorporated by reference herein. System 400 includes instrument 402 and piercing kit 408. Instrument 402 includes a plunger 404, which is depressed by the trained professional to actually perform the piercing, and push rod 406, which physically pushes a piercing post through the portion of the body part to be pierced to perform the piercing.

Piercing kit 408 includes, in accordance with the present invention, at least a piercing post 102 that includes first magnet 106 mounted within the cavity 114 therein. Piercing kit 408 may also include a backing 218 so that manipulation of the pierced body part is kept to a minimum immediately after piercing. Once instrument 400 has been used to insert piercing post 102 into the ear or other body part, the user may select from a multitude of interchangeable ornamental elements. Removal and replacement of the ornamental element only requires a slight pressure on one side of the element to break the magnetic attraction between first and second magnets 106 and 108, respectively.

Figure 5:
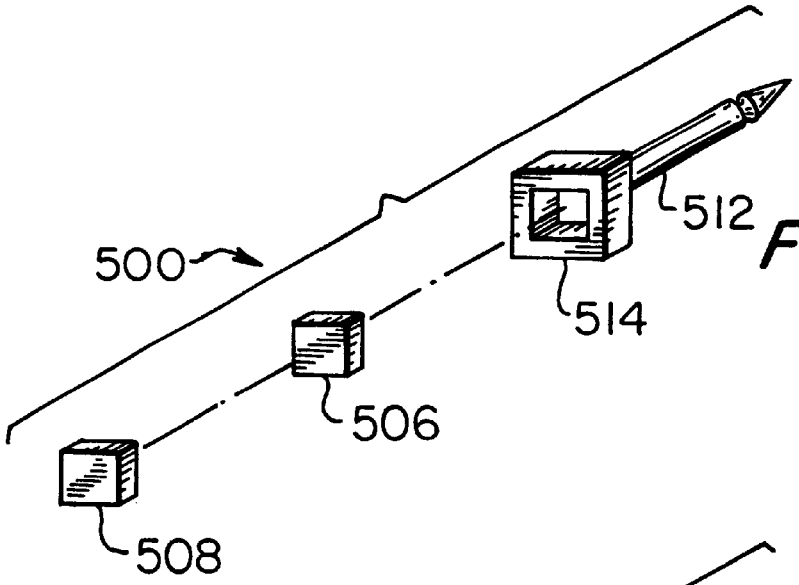
FIG. 5 is an exploded perspective illustration of a piercing earing having squared-shaped alignment targets constructed in accordance with the principles of the present invention.
Figure 6:
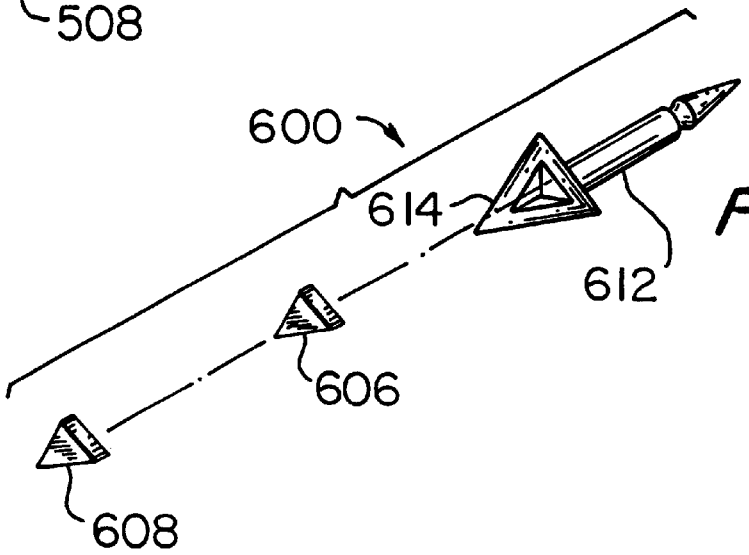
FIG. 6 is an exploded perspective illustration of a piercing earing having triangle-shaped alignment targets constructed in accordance with the principles of the present invention.

FIGS. 5 and 6 show two alternate configurations of the shape of the alignment targets of the piercing earrings of the present invention. For example, FIG. 1 shows piercing earring 100 having disc-shaped first magnet 106 and second disc-shaped magnet 108. FIG. 5 shows piercing earring 500 (having piercing post 512) to include square-shaped first magnet 506 (which fits in square-shaped cavity 514) and square-shaped second magnet 508. FIG. 6 shows piercing earring 600 (having piercing post 612) to include triangle-shaped first magnet 606 (which fits in triangle-shaped cavity 614) and triangle-shaped second magnet 608.

Figure 7:
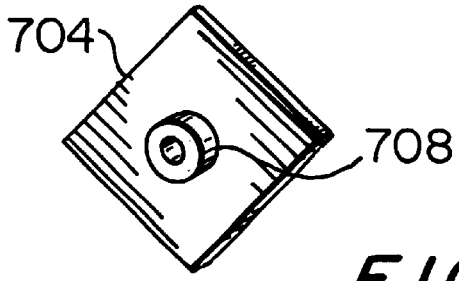
FIG. 7 is an illustrative view of an ornamental element having a cup-shaped alignment target constructed in accordance with the principles of the present invention.

FIG. 7 shows another embodiment of an ornamental element that may be utilized in accordance with the principles of the present invention. In particular, FIG. 7 shows ornamental element 704 which includes cup-shaped mating alignment target 708 configured to mate with a corresponding post alignment target.

Persons skilled in the art will thus appreciate that the present invention can be practiced by other than the described embodiments, which are presented for purposes of illustration and not of limitation, and the present invention is limited only by the claims which follow.

What is claimed is:

1. A piercing earring comprising:

a piercing pose having a point at a proximal end, and a post alignment target and first magnet at a distal end, said point being sufficient to pierce a body part; and an ornamental earring element having a mating alignment target comprising ferromagnetic material, said first magnet and said ferromagnetic material being configured to be magnetically attracted to each other, said element being removably attached to said distal end of said post such what said post alignment target and said mating alignment target are generally aligned with each other.

2. The piercing earring of claim 1, wherein said ferromagnetic material is a second magnet.

3. The piercing earring of claim 2, wherein said first and second magnets have a substantially similar shape.

4. The piercing earring of claim 3, wherein said shape is circular.

5. The piercing earring of claim 3, wherein said shape is multi-sided.

6. The piercing earring of claim 5, wherein said multi-sided shape is square.

7. The piercing earring of claim 2, wherein said second magnet is said mating alignment target.

8. The piercing earring of claim 1, wherein said ferromagnetic material is stainless steel.

9. The piercing earring of claim 1, wherein said post alignment target and said mating alignment target each includes one half of a matching keying, such that when said alignment targets are mated together said keying halves are interlocked.

10. The piercing earring of claim 9, wherein said post alignment target includes a male keying and said mating alignment target includes a female keying.

11. The piercing earring of claim 9, wherein said post alignment target includes a female keying and said mating alignment target includes a male keying.

12. The piercing earring of claim 1 further comprising:

an earring backing that may be removably attached to said piercing post.

13. The piercing earring of claim 12, wherein said piercing post has an annular indentation in the proximity of said proximal end, said earring backing being capable of being connected to said indentation to removably attach said backing to said post.

14. The piercing earring of claim 1, wherein one of said post alignment target and said mating target is a substantially tubular member having a closed end, said tubular member and said other target having a substantially similar shape.

15. The piercing earring of claim 14, wherein said shape is circular.

16. The piercing earring of claim 14, wherein said shape is multi-sided.

17. The piercing earring of claim 16, wherein said multi-sided shape is square.

18. The piercing earring of claim 1, wherein said post alignment target is a substantially cup-shaped target permanently fixed to the distal end of said post.

19. The piercing earring of claim 18, wherein said first magnet is fixedly mounted inside said cup-shaped target.

20. The piercing earring of claim 19, wherein said mating target is a disc-shaped target of a size that fits within said cup-shaped target.

21. The piercing earring of claim 18, wherein ferromagnetic material is a second magnet.

22. The piercing earring of claim 21, wherein said second magnet is disc-shaped that is one of a size similar to said mating target and a size smaller than said mating target said second magnet being fixedly mounted to said mating target.

23. The piercing earring of claim 1, wherein said post alignment target is a substantially disc-shaped target permanently fixed to the distal end of said post.

24. The piercing earring of claim 23, wherein said first magnet target is disc-shaped that is one of a size similar to said post alignment target and a size smaller than said post alignment target, said first magnet being fixedly mounted to said post alignment target.

25. The piercing earring of claim 24, wherein said mating target is a substantially cup-shaped target permanently affixed to an ornament.

26. The piercing earring of claim 23, wherein said ferromagnetic material is a second magnet.

27. The piercing earring of claim 26, wherein said second magnet is Fixedly mounted inside a cup-shaped target.

28. An ornamental earring element comprising:

an ornamental earring element having a mating alignment target comprising ferromagnetic material, said mating alignment target including a first keyway portion that may be removably mated with a second keyway portion of a post alignment target, such that when said first and second keyways are mated, rotation of said ornamental earring element causes a similar rotation of said post alignment target.

29. The ornamental earring element of claim 28, wherein said ferromagnetic material is a magnet.

30. The ornamental earring element of claim 29, wherein said magnet is formed such that said magnet includes said first keyway portion.

31. The ornamental earring element of claim 28, wherein said ferromagnetic material is stainless steel.

32. The ornamental earring element of claim 31, wherein said ferromagnetic material is formed such that it includes said first keyway portion.

33. A method of following a prescribed healing regimen for a user having a newly pierced body member that was pierced with a piercing post having a piercing point at a proximal end, and a post alignment target and first magnet at a distal end, comprising:

removably attaching an ornamental earring element having a mating alignment target comprising ferromagnetic material to said distal end of said post such that said post alignment target and said mating alignment target are generally aligned with each other, said first magnet and said ferromagnetic material being configured to be magnetically attracted to each other, said element being removably attached; and replacing said removably attached element with a different ornamental element which also has a mating alignment target comprising ferromagnetic material prior to removal of said piercing post from said body member.

34. The method of claim 33, wherein removably attaching comprises:

aligning a first keyway port-on of said mating alignment target with a second keyway portion of said post alignment target; and mating said first portion with said second portion so that rotation of said removably attached element causes rotation of said piercing post.

35. The method of claim 33, wherein replacing comprises:

aligning a first keyway portion of said mating alignment target with a second keyway portion of said post alignment target; and mating said first portion with said second portion so that rotation of said removably attached element causes rotation of said piercing post.

* * * * *

UNITED STATES PATENT AND TRADEMARK OFFICE

CERTIFICATE OF CORRECTION

PATENT NO. : 6,305,192 B1
DATED : October 23, 2001
INVENTOR(S) : Peter A. Indiveri et al.

It is certified that error appears in the above-identified patent and that said Letters Patent is hereby corrected as shown below:

Column 6,
Line 62, change "pose" to -- post --;

Column 8,
Line 10, change "Fixedly" to -- fixedly --;
Line 50, change "port-on" to -- portion --.

Signed and Sealed this

Thirtieth Day of April, 2002

*Attest:*

*Attesting Officer*

JAMES E. ROGAN
*Director of the United States Patent and Trademark Office*